US010260452B2

(12) United States Patent
Linke et al.

(10) Patent No.: US 10,260,452 B2
(45) Date of Patent: Apr. 16, 2019

(54) ASSEMBLY OF A PISTON AND AN OIL SPRAY NOZZLE FOR AN INTERNAL COMBUSTION ENGINE

(71) Applicant: Mahle International GmbH, Stuttgart (DE)

(72) Inventors: Timo Linke, Stuttgart (DE); Rainer Scharp, Vaihingen (DE)

(73) Assignee: Mahle International GmbH (DE)

( * ) Notice: Subject to any disclaimer, the term of this patent is extended or adjusted under 35 U.S.C. 154(b) by 197 days.

(21) Appl. No.: 15/303,220

(22) PCT Filed: Apr. 9, 2015

(86) PCT No.: PCT/EP2015/000749
§ 371 (c)(1),
(2) Date: Oct. 10, 2016

(87) PCT Pub. No.: WO2015/154877
PCT Pub. Date: Oct. 15, 2015

(65) Prior Publication Data

US 2017/0030292 A1 Feb. 2, 2017

(30) Foreign Application Priority Data

Apr. 11, 2014 (DE) ..... 10 2014 005 364

(51) Int. Cl.
*F02F 3/22* (2006.01)
*F01P 3/10* (2006.01)
*F01P 3/08* (2006.01)

(52) U.S. Cl.
CPC ..... *F02F 3/22* (2013.01); *F01P 3/08* (2013.01); *F01P 3/10* (2013.01)

(58) Field of Classification Search
CPC .. F02F 3/22; F02F 3/0015; F02F 3/225; F01P 3/06; F01P 3/08; F01P 3/10; F01M 1/08
See application file for complete search history.

(56) References Cited

U.S. PATENT DOCUMENTS 4,129,108 A * 12/1978 Elsbett ..... F01P 3/08 123/193.6
4,206,726 A * 6/1980 Johnson, Jr. ..... F01P 3/08 123/41.35

(Continued)

FOREIGN PATENT DOCUMENTS

DE 2539470 A1 3/1977
DE 2831566 A1 2/1979

(Continued)

OTHER PUBLICATIONS

English abstract for DE-102006056011.

(Continued)

*Primary Examiner* — Grant Moubry
(74) *Attorney, Agent, or Firm* — Fishman Stewart PLLC

(57) ABSTRACT

An assembly for cooling oil for an internal combustion engine may include a piston having a piston head and a piston skirt. The piston head may include a piston crown with an undersurface having an outer region configured as a guiding surface for the cooling oil, a circumferential ring part, and, in a region of the circumferential ring part, a circumferential cooling channel with at least one feed opening for the cooling oil. The assembly may also include a first oil spray nozzle for creating a first cooling oil jet directed at the feed opening, and a second oil spray nozzle for creating a second cooling oil jet directed at the guiding surface such that the second cooling oil jet may deflect and flow along the guiding surface in a direction of the undersurface. At least the first oil spray nozzle may be positioned below the piston skirt.

19 Claims, 4 Drawing Sheets

(56) References Cited

U.S. PATENT DOCUMENTS

| | | | | |
|---|---|---|---|---|
| 4,979,473 | A * | 12/1990 | Lee | F01P 3/08 123/41.35 |
| 5,267,534 | A * | 12/1993 | Berlinger | F01P 3/08 123/41.35 |
| 6,895,905 | B2 * | 5/2005 | Bontaz | F01P 3/08 123/41.35 |
| 7,987,831 | B2 * | 8/2011 | Seifried | B23B 27/04 123/193.6 |
| 8,267,053 | B2 * | 9/2012 | Abe | F01M 1/08 123/41.34 |
| 8,661,965 | B2 | 3/2014 | Scharp et al. | |
| 9,476,344 | B2 * | 10/2016 | Clement | F01P 3/08 |
| 9,765,728 | B2 * | 9/2017 | Bischofberger | F02F 3/18 |
| 2008/0078339 | A1 * | 4/2008 | Obermeier | F01P 3/08 123/41.35 |
| 2015/0247475 | A1 | 9/2015 | Bischofberger et al. | |
| 2016/0186642 | A1 * | 6/2016 | Honda | F01M 1/08 123/41.35 |

FOREIGN PATENT DOCUMENTS

| | | | |
|---|---|---|---|
| DE | 102006056011 | A1 | 5/2008 |
| DE | 102009056922 | A1 | 6/2011 |
| DE | 102010056220 | A1 | 6/2012 |
| DE | 102012017217 | A1 | 5/2014 |
| EP | 1394376 | A1 | 3/2004 |
| JP | S59-156114 | A | 9/1984 |
| JP | H0835425 | A | 2/1996 |
| JP | H11132101 | A | 5/1999 |

OTHER PUBLICATIONS

English abstract for DE-102009056922.
German Search Report for DE-102014005364.4, dated Dec. 12, 2014.
English abstract for JP-H0835425.
English abstract for H11132101.

* cited by examiner

ASSEMBLY OF A PISTON AND AN OIL SPRAY NOZZLE FOR AN INTERNAL COMBUSTION ENGINE

CROSS REFERENCE TO RELATED APPLICATIONS

This application claims priority to German Patent Application No. DE 10 2014 005 364.4, filed on Apr. 11, 2014, and International Application No. PCT/EP2015/000749, filed on Apr. 9, 2015, the contents of which are hereby incorporated by reference in their entirety.

TECHNICAL FIELD

The present invention concerns an assembly with a piston and a spray nozzle for cooling oil for an internal combustion engine, wherein the piston comprises a piston head and a piston skirt, wherein the piston head comprises a piston crown with an undersurface, a circumferential ring part, and in the region of the ring part a circumferential cooling channel with at least one feed opening for cooling oil, wherein the oil spray nozzle is provided below the piston skirt.

BACKGROUND

An assembly of this kind involves a piston with a cooling channel, i.e., the cooling of the piston is accomplished by the spraying of cooling oil from the end near the piston skirt in the direction of the at least one feed opening for cooling oil in the cooling channel. The cooling oil penetrates into the cooling channel and accomplishes here in a manner known per sea cooling of the piston especially in the region of the piston head.

Due to the high thermal stress of modern pistons, it is desirable to also cool the undersurface of the piston crown, the so-called "dome". For this, DE 10 2006 056 011 A1 proposes providing three spray nozzles for cooling oil, two of which are meant to serve for the supplying of the cooling channel with cooling oil and the third for the cooling of the undersurface of the piston crown. The cooling oil jet for the cooling of the undersurface of the piston crown is, however, widely spread out, so that its cooling action is inadequate, especially since the path of the cooling oil jet from the connecting rod or structures inside the piston is at least partly blocked.

To solve this problem, the German patent application 10 2013 013 962.7 proposes having only one oil spray nozzle as well as a jet divider inside the piston, which deflects a portion of the cooling oil jet ejected by the oil spray nozzle specifically onto the undersurface of the piston crown. However, the cooling action is not optimal, since due to the dividing of the cooling oil jet both for the cooling channel and also for the undersurface of the piston crown a smaller cooling oil quantity is available.

SUMMARY

The problem which the present invention proposes to solve therefore consists in modifying a piston of this kind so that an effective and technically simple oil cooling of both the cooling channel and the undersurface of the piston crown is achieved.

The solution consists in that a first oil spray nozzle is provided for creating a first cooling oil jet directed at the at least one feed opening, an outer region of the undersurface of the piston crown is configured as a guiding surface for cooling oil, a second oil spray nozzle is provided for creating a second cooling oil jet directed at the guiding surface so that the second cooling oil jet impinges on a defined starting point such that it is deflected, proceeding from the starting point, in the direction of the guiding surface and the resulting cooling oil flows along the guiding surface in the direction of the undersurface of the piston crown.

The assembly provided according to the invention means that the cooling oil quantity of both the first and the second cooling oil jet can be adjusted individually, so that adequate cooling oil is available for both the cooling channel and the undersurface of the piston crown.

Thanks to this optimization of the cooling oil quantity of the two cooling oil jets, an especially effective cooling of the piston is accomplished with technically simple means.

Advantageous modifications will emerge from the subclaims.

Especially preferably, the center axis of the first oil spray nozzle is oriented parallel to the center axis of the piston. Instead of or in addition to this, the center axis of the second oil spray nozzle is oriented inclined in relation to the center axis of the piston, so that it subtends an acute angle $\alpha$ with the first oil spray nozzle. This ensures that the largest possible cooling oil quantity gets into the cooling channel or is directed toward the guiding surface during the entire piston stroke.

Preferably, the first oil spray nozzle has a larger nozzle cross section than the second oil spray nozzle, that is, the first cooling oil jet contains a larger cooling oil quantity than the second cooling oil jet. This is expedient, since the cooling channel can accommodate a larger cooling oil quantity than can be deflected at the defined starting point of the guiding surface in the direction of the undersurface of the piston crown.

Especially preferably, the distance between the defined starting point of the guiding surface and the center axis of the piston is 1.2 to 1.6 times the outer radius of a small connecting rod eye of a connecting rod accommodated inside the piston. This ensures that the second cooling oil jet is reliably deflected past the small connecting rod eye during the entire piston stroke and impinges entirely on the defined starting point on the guiding surface.

If the guiding surface subtends an angle $\gamma$ of 15 angle degrees to 55 angle degrees with a horizontal line running perpendicular to the center axis of the piston, the cooling oil from the second cooling oil jet will be guided especially effectively alone the guiding surface and the undersurface of the piston crown. Especially preferably, the undersurface subtends an angle ß with the horizontal line, wherein the difference angle relative to the angles ß and $\gamma$ is between 0 angle degrees and 15 angle degrees, i.e., the angle $\gamma$ should not be more than 15 angle degrees larger or smaller than the angle ß. This has the effect that the second cooling oil jet is deflected at the defined starting point of the guiding surface especially effectively in the direction of the guiding surface and streams especially effectively along the guiding surface and the undersurface of the piston crown, so that the cooling effect is optimized.

Preferably, the guiding surface passes into the undersurface at a defined point, especially steadily, in order to avoid presenting a flow obstacle to the flowing cooling oil. The piston according to the invention preferably has a thermally decoupled piston skirt. This has the effect that the thermal expansion in the region of the piston skirt facing the piston head is significantly less than that in a piston with a piston skirt connected to the piston head. Moreover, this piston design enables a piston fine contour with less convexity in the region of the piston skirt facing the piston head. This achieves a good guidance behavior of the piston in all temperature ranges during engine operation.

A preferred modification of the piston according to the invention calls for the piston skirt having two piston bosses which are joined together by two running surfaces having inner surfaces and the inner surface of only the running surface at the pressure side of the piston is joined by a connection web to the undersurface of the piston crown. Such a connection of the piston skirt to the undersurface of the piston crown at the pressure side results in a lessening of piston noise during engine operation. Since the piston skirt is not connected to the counterpressure side, it is especially flexible in engine operation, so that there is better seizure resistance.

The assembly according to the invention can be implemented with all the usual piston types, especially with single-piece pistons, pistons made from at least two permanently joined components, skirt pistons, pistons with enclosed cooling channel and pistons with downward opening cooling channel closed with a closure element. Especially preferred are pistons made from a piston base body and a piston ring element.

BRIEF DESCRIPTION OF THE DRAWINGS

A sample embodiment of the present invention shall be explained more closely in the following with the aid of the enclosed drawings. There are shown in a schematic representation, not true to scale.

DETAILED DESCRIPTION

Figure 1:
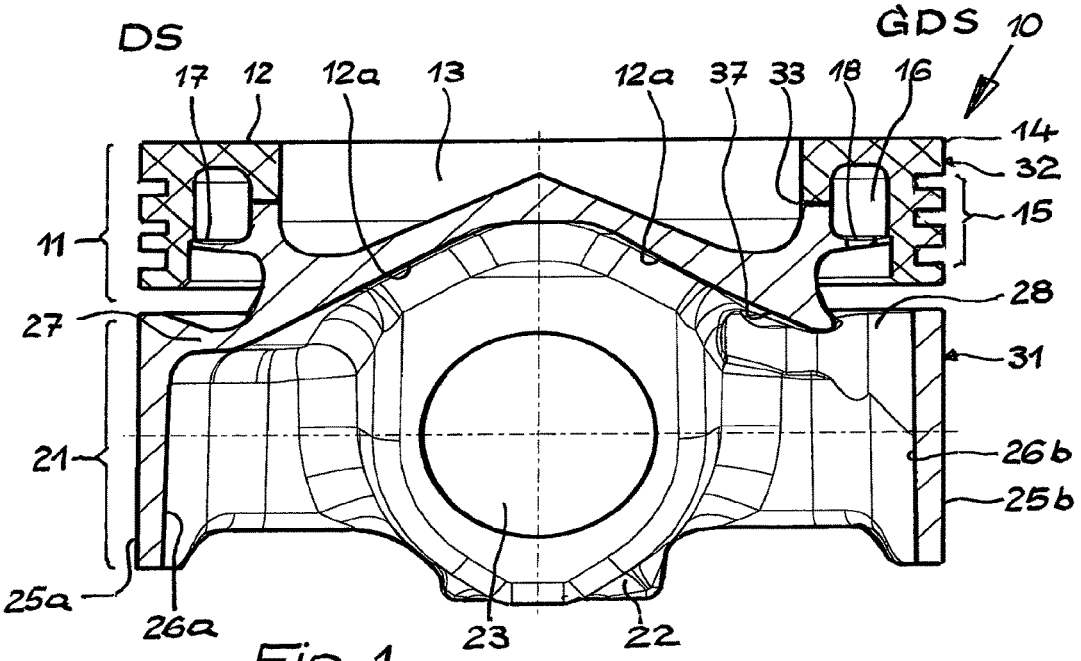
FIG. 1, a sample embodiment of a piston for an assembly according to the invention in cross section.
Figure 2:
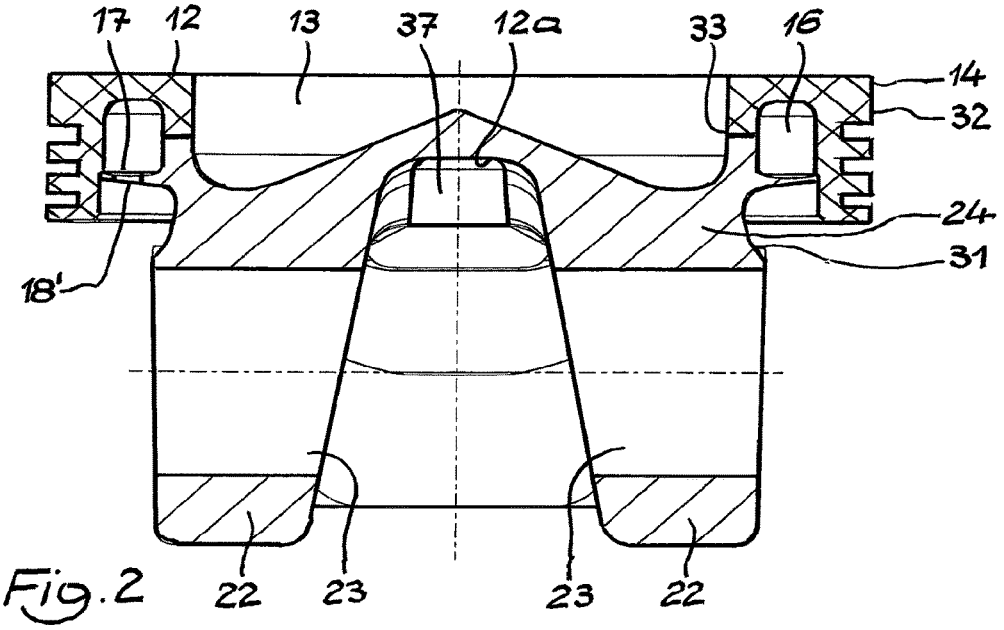
FIG. 2, a representation of the piston according to FIG. 1, rotated by 90°.

FIGS. 1 and 2 show a sample embodiment of a piston 10 for an assembly 100 according to the invention. The piston 10, as is basically known, can be forged or cast as a single-piece blank, and the cooling channel is introduced in the blank by a chip-removing machining. In the sample embodiment, the piston 10 is assembled from a piston base body 31 and a piston ring element 32, which can be cast or forged in a manner known per se and are joined together by a weld seam 33, such as by means of electron beam welding or laser welding. The weld seam 33 in the sample embodiment is arranged in a wall region of the combustion cavity. The piston base body 31 and the piston ring element 32 are made of steel in the sample embodiment. But they can also be made of a light metal or a combination of the two materials.

The piston 10 comprises a piston head 11 with a piston crown 12 having a combustion cavity 13, a circumferential fire land 14 and a circumferential ring part 15 with annular grooves to accommodate piston rings (not shown). At the height of the ring part 15 there is provided a circumferential, downwardly open cooling channel 16, which is closed by a closure element 17. In the sample embodiment, the closure element 17 is designed as a circumferential collar forming a single piece with the piston base body 31, the free end being adjacent to the inner surface of the piston ring element 32. The closure element 17 is provided with a feed opening 18 for cooling oil.

The piston 10 moreover comprises a piston skirt 21, thermally decoupled from the piston head 11, with piston bosses 22 and boss bores 23 to accommodate a piston bolt (not shown). The piston bosses 22 are connected by boss connections 24 to the undersurface 12*a* of the piston crown 12. The piston bosses 22 are joined together by running surfaces 25*a*, 25*b*. At the pressure side DS of the piston 10, the inner surface 26*a* of the running surface 25*a* is joined by a connection web 27 to the undersurface 12*a* of the piston crown 12. At the counterpressure side GDS of the piston 10, the inner surface 26*b* of the running surface 25*b* is not joined to the undersurface 12*a* of the piston crown 12. The inner surface 26*b* is spaced apart from the piston crown 12, so that a continuous opening 28 is formed in the direction of the cooling channel 16.

Figure 3:
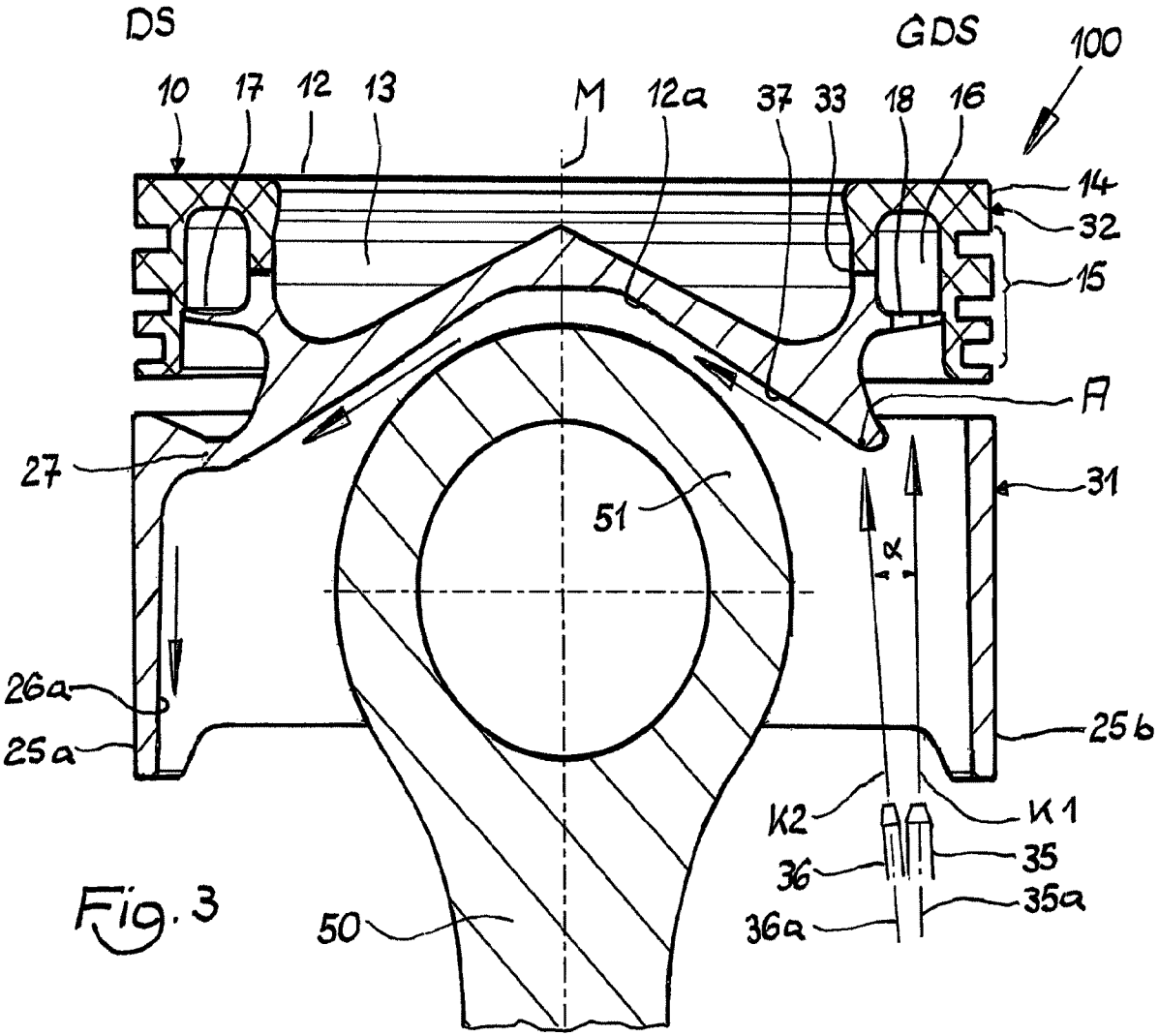
FIG. 3, a representation of a sample embodiment of the assembly according to the invention with a piston according to FIGS. 1 and 2.
Figure 4:
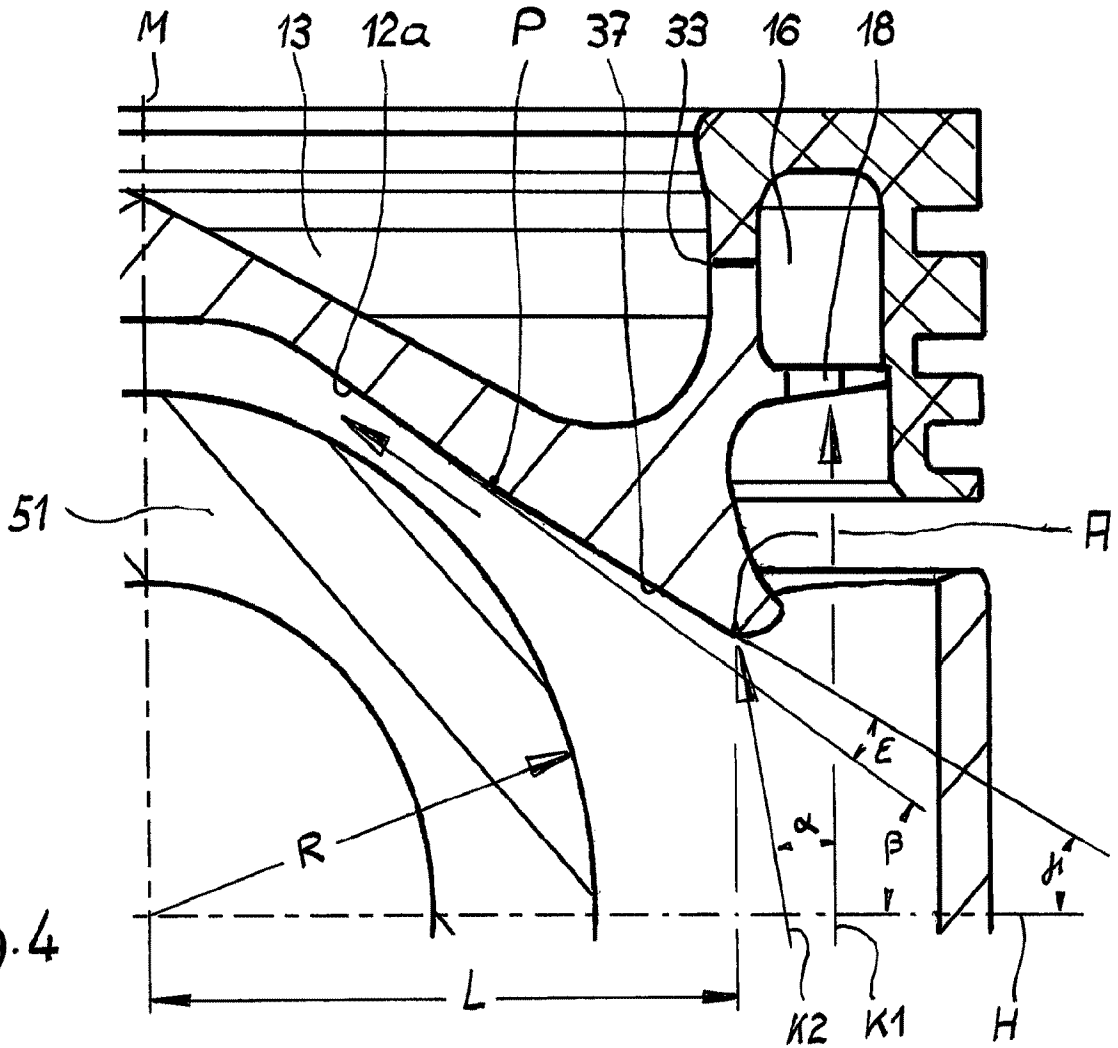
FIG. 4, a magnified partial representation of the assembly according to FIG. 3 with a small connecting rod eye of a connecting rod accommodated in the piston.
Figure 5:
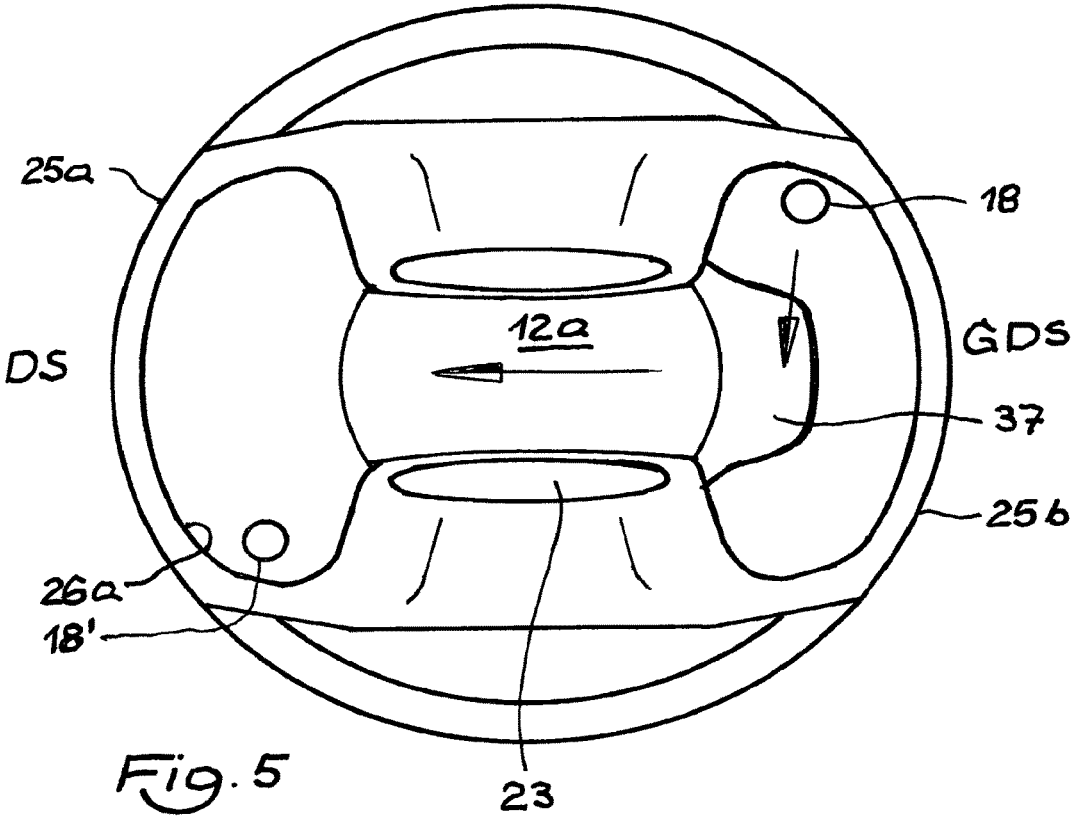
FIG. 5, a bottom view of the piston according to FIG. 1 with a representation of the flow path of the cooling oil.

FIGS. 3 to 5 show a sample embodiment of an assembly 100 according to the invention with a piston 10 according to FIGS. 1 and 2. The cooling of the assembly 100 is indicated by arrows, showing the flow of the cooling oil. In FIGS. 3 and 4 there is shown in addition a connecting rod 50, whose small connecting rod eye 51 is received inside the piston 10. For reasons of clarity, the piston bolt is not shown.

Especially in the magnified representation of FIG. 3 one can see that an outer region of the undersurface 12*a* of the piston crown 12 is configured as a guiding surface 37 at the counterpressure side GDS of the piston 10. In the sample embodiment, the undersurface 12*a* of the piston crown 12 passes at a defined point P, steadily in the sample embodiment, into the guiding surface 37. The guiding surface 37 is designed to be less steep than the undersurface 12*a* with respect to the center axis M. The guiding surface 37 in the sample embodiment subtends an angle $\gamma$ of 15 degrees to 55 degrees with a horizontal line H running perpendicular to the center axis M of the piston 10. The undersurface 12*a* subtends with the horizontal line H an angle ß which in the sample embodiment is lamer than the angle $\gamma$. The angle ß, moreover, should differ by no more than 15 angle degrees from the angle $\gamma$. This means that the guiding surface 37 and the undersurface 12*a* together subtend an angle $\varepsilon$ of at most 15 degrees. In the sample embodiment, the guiding surface 37 extends in an arc. There is formed here a definite starting point A, at which the imaginary extension of the guiding surface 37 lies tangentially to this. Thus, the guiding surface 37 begins at the defined starting point A and ends at the defined point P. The distance L between the defined starting point A and the center axis M of the piston 10 is 1.2 to 1.6 times the outer radius R of the small connecting rod eye 51.

The assembly 100 according to the invention comprises, besides the piston 10, two oil spray nozzles 35, 36, arranged beneath the piston skirt 21. The center axis 35*a* of the first oil spray nozzle 35 is oriented parallel to the center axis M of the piston 10 and to the feed opening 18 and serves to supply the cooling channel 16 with cooling oil. The center axis 36*a* of the second oil spray nozzle 36 is arranged inclined in regard to the center axis M of the piston 10 and oriented toward the guiding surface 37, in the sample embodiment to the defined starting point A of the guiding surface 37, so that it subtends an acute angle with the first oil spray nozzle 35. The second oil spray nozzle 36 thus serves for the cooling of the guiding surface 37 as well as the undersurface 12*a* of the piston crown 12 with cooling oil.

The first oil spray nozzle 35 in the sample embodiment has a larger nozzle cross section than the second oil spray nozzle 36, that is, the first cooling oil jet K1 ejected by the first oil spray nozzle contains a larger cooling oil quantity than the second cooling oil jet K2 ejected by the second oil spray nozzle. In this way, both the cooling channel 16 on the one hand and the guiding surface 37 or the undersurface 12*a* can be supplied each with the optimal cooling oil quantity.

As can be seen especially in FIGS. 4 and 5, the first cooling oil jet K1 ejected by the first oil spray nozzle 35 impinges on the feed opening 18 for cooling oil, which is configured in the closure element 17 of the cooling channel 16, so that the cooling channel 16 is continuously supplied with an adequate cooling oil quantity. Through a drain opening 18' see FIG. 5), the cooling oil can again flow away from the cooling channel 16. The second cooling oil jet K2 ejected by the second oil spray nozzle 36 impinges in the sample embodiment on the defined starting point A of the guiding surface 37. Thanks to the above-described dimensions, the second cooling oil jet is deflected in optimal fashion in the direction of the guiding surface 37. The cooling oil flow impinging in this way on the guiding surface 37 (indicated by arrows) now flows along the guiding surface 37 and then along the undersurface 12*a* of the piston crown. As can be seen from FIG. 3, the cooling oil flow streams along the entire undersurface 12*a* of the piston crown 12, until it drains off on the inner surface 26*a* of the running surface 25*a* in the direction of the crankcase.

The invention claimed is:

1. An assembly for cooling oil for an internal combustion engine, comprising:

a piston having a piston head and a piston skirt, the piston head including a piston crown with an undersurface having an outer region configured as a guiding surface for the cooling oil, a circumferential ring part, and in a region of the circumferential ring part a circumferential cooling channel with at least one feed opening for the cooling oil;

a first oil spray nozzle for creating a first cooling oil jet directed at the at least one feed opening; and a second oil spray nozzle for creating a second cooling oil jet directed at the guiding surface so that the second cooling oil jet impinges on a defined starting point such that the second cooling oil jet is deflected, proceeding from the defined starting point, in a direction of the guiding surface and a resulting cooling oil flow streams along the guiding surface in a direction of the undersurface of the piston crown;

wherein at least the first oil spray nozzle is positioned below the piston skirt; and wherein the guiding surface is less steep than the rest of the undersurface with respect to a center axis of the piston.

2. The assembly as claimed in claim 1, wherein a center axis of the first oil spray nozzle is oriented parallel to the center axis of the piston.

3. The assembly as claimed in claim 1, wherein a center axis of the second oil spray nozzle is oriented inclined in relation to the center axis of the piston.

4. The assembly as claimed in claim 1, wherein the first oil spray nozzle has a larger nozzle cross section than the second oil spray nozzle.

5. The assembly as claimed in claim 1, further comprising a connecting rod accommodated inside the piston, wherein a distance between the defined starting point and the center axis of the piston is 1.2 to 1.6 times an outer radius of a small connecting rod eye of the connecting rod.

6. The assembly as claimed in claim 1, wherein the guiding surface subtends an angle of 15 degrees to 55 degrees from a horizontal line running perpendicular to the center axis of the piston.

7. The assembly as claimed in claim 6, wherein the undersurface subtends an angle from the horizontal line, wherein a difference between the respective angles of the guiding surface and the undersurface is at most 15 degrees.

8. The assembly as claimed in claim 1, wherein the guiding surface passes into the undersurface at a defined point.

9. The assembly as claimed in claim 8, wherein the guiding surface passes steadily into the undersurface.

10. The assembly as claimed in claim 1, wherein the piston skirt is thermally decoupled from the piston head.

11. The assembly as claimed in claim 1, wherein the piston skirt has two piston bosses joined together by two running surfaces having respective inner surfaces, wherein the inner surface of one of the running surfaces at a pressure side of the piston is joined by a connection web to the undersurface of the piston crown.

12. The assembly as claimed in claim 1, wherein the piston is assembled from at least two permanently joined components.

13. The assembly as claimed in claim 12 wherein the at least two permanently joined components include a piston base body and a piston ring element.

14. An assembly for cooling oil for an internal combustion engine, comprising:

a piston having a piston head and a piston skirt, the piston head including a piston crown with an undersurface having an outer region configured as a guiding surface for the cooling oil, a circumferential ring part, and in a region of the circumferential ring part a circumferential cooling channel with at least one feed opening for the cooling oil;

a first oil spray nozzle for creating a first cooling oil jet directed at the at least one feed opening;

a second oil spray nozzle for creating a second cooling oil jet directed at the guiding surface so that the second cooling oil jet impinges on a defined starting point such that the second cooling oil jet is deflected, proceeding from the defined starting point, in a direction of the guiding surface and a resulting cooling oil flow streams along the guiding surface in a direction of the undersurface of the piston crown; and a connecting rod accommodated inside the piston, wherein a distance between the defined starting point and a center axis of the piston is 1.2 to 1.6 times an outer radius of a small connecting rod eye of the connecting rod;

wherein the first oil spray nozzle and the second spray nozzle are positioned below the piston skirt; and wherein a center axis of the first oil spray nozzle is oriented parallel to the center axis of the piston, and a center axis of the second oil spray nozzle is oriented inclined in relation to the center axis of the piston.

15. The assembly as claimed in claim 14, wherein the first oil spray nozzle has a larger nozzle cross section than the second oil spray nozzle.

16. The assembly as claimed in claim 1, wherein the guiding surface passes into the undersurface at a defined point.

17. The assembly as claimed in claim 14, wherein the guiding surface subtends an angle of 15 degrees to 55 degrees from a horizontal line running perpendicular to the center axis of the piston.

18. The assembly as claimed in claim 17, wherein the undersurface subtends an angle from the horizontal line, wherein a difference between the respective angles of the guiding surface and the undersurface is at most 15 degrees.

19. An assembly for cooling oil for an internal combustion engine, comprising:

a piston having a piston head and a piston skirt, the piston head including a piston crown with an undersurface having an outer region configured as a guiding surface for the cooling oil, a circumferential ring part, and in a region of the circumferential ring part a circumferential cooling channel with at least one feed opening for the cooling oil;

a first oil spray nozzle for creating a first cooling oil jet directed at the at least one feed opening;

a second oil spray nozzle for creating a second cooling oil jet directed at the guiding surface so that the second cooling oil jet impinges on a defined starting point such that the second cooling oil jet is deflected, proceeding from the defined starting point, in a direction of the guiding surface and a resulting cooling oil flow streams along the guiding surface in a direction of the undersurface of the piston crown; and a connecting rod accommodated inside the piston, wherein a distance between the defined starting point and a center axis of the piston is 1.2 to 1.6 times an outer radius of a small connecting rod eye of the connecting rod;

wherein at least the first oil spray nozzle is positioned below the piston skirt.

* * * * *